US009640093B1

(12) United States Patent
Severson, Jr. et al.

(10) Patent No.: US 9,640,093 B1
(45) Date of Patent: May 2, 2017

(54) IMAGE DISPLAY PLATFORM THAT CONNECTS TO THE CEMETERY MONUMENT VASE AND OR ITS MOUNTING

(71) Applicants: Howard Severson, Jr., San Leandro, CA (US); Tom J. Francis, San Leandro, CA (US)

(72) Inventors: Howard Severson, Jr., San Leandro, CA (US); Tom J. Francis, San Leandro, CA (US)

( * ) Notice: Subject to any disclaimer, the term of this patent is extended or adjusted under 35 U.S.C. 154(b) by 683 days.

(21) Appl. No.: 13/802,246

(22) Filed: Mar. 13, 2013

(51) Int. Cl.
*G09F 7/18* (2006.01)

(52) U.S. Cl.
CPC ..... *G09F 7/18* (2013.01)

(58) Field of Classification Search
CPC ..... E04H 13/003; E04H 13/00; G09F 19/00; G09F 7/18; G09F 3/12; G09F 3/04; G09F 1/04; G09F 3/10; G09F 3/0288; G09F 3/206; G09F 3/14; G09F 3/20; B65D 23/14
See application file for complete search history.

(56) References Cited

U.S. PATENT DOCUMENTS 1,763,130 A * 6/1930 Cartwright ..... A47G 7/06 248/146
2,010,246 A * 8/1935 Slawson ..... E04H 13/003 206/423
3,001,953 A * 9/1961 Huber ..... B01J 23/70 48/198.7
6,922,927 B1 * 8/2005 Harmon ..... G09F 7/18 40/124.5

* cited by examiner

*Primary Examiner* — Cassandra Davis

(57) ABSTRACT

A new and innovative way to display images at a gravesite. This by using the monument mounted flower vase or vase mounting as the placement point for the display. The display can be introduced to an existing vase or mounting through the use of an adapter. A mounting point could also be incorporated into the vase or mounting at the time of manufacture, this to support the image display.

1 Claim, 31 Drawing Sheets

IMAGE DISPLAY PLATFORM THAT CONNECTS TO THE CEMETERY MONUMENT VASE AND OR ITS MOUNTING

FIELD OF THE INVENTION

The present invention relates to a cemetery vase and photo or video display and more specifically, to the temporary or semi permanent incorporation of this display with a cemetery monument vase and or its mounting.

BACKGROUND OF THE INVENTION

The inception of our creation was born out of loss and it started life as the result of the passing of a loved one. Until that point we had never given much thought to death and dying. It was at this very emotion filled time that we were called upon to make many decisions and incur the many costs that are involved in the after care of a deceased loved one. One of the decisions we faced was that of having a permanent image affixed to our loved ones monument. We decided against this for several reasons but still wanted to have imagery displayed at our loved ones resting place. We thought that a life lived truly deserves more then one never changing static image that was as inanimate as our now deceased loved one. We surmised that there had to be a better option then those that were presently available. We got to work and after considering many ideas and directions on how to accomplish the task, diligently working over a period of several years and after building many prototypes, our creation took shape.

Until now there has not been a cost effective, easy to use and secure way to display photographic or video images at a loved ones gravesite. All that is required to use our creation is that the deceased's gravestone or marker has the provision for a flower vase, cup and or mount, as this is our connection point to the monument. As many people choose to have their grave markers equipped with a flower vase or cup mounts, we thought that the vase or cup would be the ideal place to attach or incorporate an image display. We also know that upon viewing, the eye will gravitate to the beautiful flowers, the vase and to our creation. To our knowledge, in the past the only option that has been available was to have a permanent display attached to or etched into the stone or marker. This can cost hundreds or thousands of dollars and in most cases is static in nature. Image choices made at the time of death may have been clouded with grief and can be regretted in the future with the permanent installation. Many cemeteries also frown on do it yourself solutions and usually forbid people from using glue or other means in attempting to mount items directly to a loved ones marker. This was another reason in choosing the vase as the place to incorporate our idea. As the vase itself is already a part of the monument and is accepted by the cemetery establishment, choosing it was the prefect location for our creation. This said, our creation is designed in a way that allows it to not interfere with the primary usage of the vase, that for the display of flowers. Our creation is nonpermanent, in that it is not permanently attached to the grave marker. It is an inexpensive option that makes it simple for those who care for the grave to periodically change their dearly departed's photo or video displays. This is very useful for holidays, birthdays, and anniversaries or for any other special occasions and allows the family and friends of the deceased to highlight moments in time. It also allows caregivers to express that though a loved one has passed they are never forgotten, this in a pleasing and dignified manor. An image or images of the departed will help to personalize the gravesite. You now have a face and no longer just have a name associated to the gravesite. Many are now choosing to be interred with others. Our creation allows several images to be displayed and can be used to depict life events of each grave resident. If lost, stolen or otherwise damaged the display can be quickly replaced or repaired without spending a fortune to have the grave marker repaired. Our invention allows the display to be viewed in perspective or in landscape view and our free-floating display allows the display to flutter in the wind. The display can be shaped or outfitted to accept custom frames, video frames and other displays. As time fades away so do some memories. Don't let your loved ones be lost to the passage of time. It has been said that every picture tells a story and that a photo is worth a thousand words. What better way to keep your loved ones memory alive then to have their smiling face (and some of what they meant to you) there to greet you when you visit their resting place. In our humble opinion, this is truly one of those great ideas that when you see it in use you will think to your self "Why didn't I think of that?"

SUMMARY OF THE INVENTION

In accordance with the present invention, there is provided a new and innovative way to display images at a gravesite. This by using the monument mounted flower vase or vase mounting as the placement point for the display. The display can be introduced to an existing vase or mounting through the use of an adapter. A mounting point could also be incorporated into the vase or mounting at the time of manufacture, this to support the image display.

A principle object and advantage of these present embodiments is to provide an image display platform or means that is attached to or is part of a cemetery and or mausoleum flower vase and or mounting.

It is there for an object of these embodiment to provide a non permanent or semi permanent means to display photos in a cemetery or mausoleum setting that incorporates the monuments flower vase or mounting.

It is also an object of these embodiments is to provide another option to those currently available at this time, this for the display of images in a cemetery or mausoleum setting.

It is also an object of these embodiments is to provide an inexpensive, attractive and easy to use and install option to those that are presently available.

It is also an object of these embodiments is to provide the grave care giver with the option to have changeability when it comes to the images displayed at the departed's place of rest.

It is also an object of these embodiments is to provide a product that if lost, stolen or vandalized, can be quickly and inexpensively be replaced.

It is also an object of these embodiments is to provide choices for family and loved ones at a later time, this when decisions are less clouded with grief and loss.

It is also an object of these embodiments is to provide a secure way to attach a display platform to a cemetery monument that is easy to use.

It is also an object of these embodiments is to provide an almost universal way to attach a display platform to a grave marker.

It is also an object of this embodiment is to provide a visual image that personalizes and connects with the inscribed name on the monument.

It is also an object of these embodiments is to provide an image display platform that connects to the cemetery vase or mounting without interfering with the installation of a floral display.

It is also an object of these embodiments is to provide the bereaved with options that allow for a personal touch to be added to the gravesite.

It is also an object of these embodiments is to provide a medium to expand upon the deceased's life and offer more then just a name on a stone or plaque.

It is also an object of these embodiments is to provide a means of sharing a special moments or life events that occurred in the deceased life.

BRIEF DESCRIPTION OF THE DRAWINGS

A complete understanding of the present invention may be obtained by reference to the accompanying drawings, when considered in conjunction with the subsequent, detailed description, in which.

DRAWING REFERENCE NUMERALS

Figure 1:
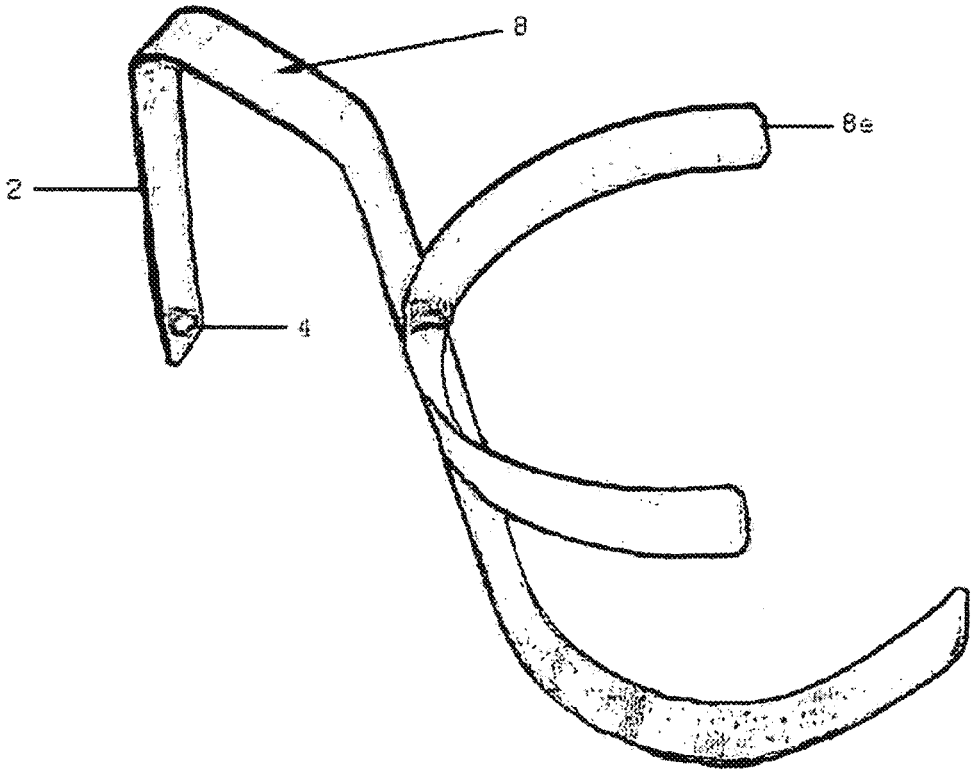
FIG. 1 is a right perspective view of an adapter embodiment that is insert adapter 8 in accordance with this embodiment.

1 IDP RM
Tab
2*e* Rolled
2*f* Hooked
2*g* Swiveled
2*h* Clasp
4 Holes
8 Insert adapter IA
8*a* Descending member
8*b* Radiused portion
8*c* Ascending member
8*d* Bent tip
8*e* Added brace
8*f* Decorative feature
11 Images
12 Boss
13 Catch
14 Boss hole
15 Surface
16 Bracket
17 Clear cover
18 Crossbars
19 Bracket ears
20 Fastener

21 Slots
22 Vase rim adapter VRA
24 Vase mount adapter VMA
25 Notch
26 Insert
27 Groove
28 Bracket fastener
33 Free form IDP
35 Slot
38 Laminate
43 Mounting with boss MWB
44 Clam shell CS
45 Vase with boss VWB
66 Flex hinge
67 Snaps
100 Vase
101 Mounting
102 Decoration
103 Frame decorative For purposes of clarity and brevity, like elements and components will bear the same designations and numbering throughout the figures.

DESCRIPTION OF THE PREFERRED EMBODIMENT

This detailed description discloses various embodiments used to attach and display image art in the cemetery environment. This is accomplished through the use of an image display platform. The platform or platforms connect to a cemetery flower vessel and or vessel mount through the use of an adapter. The terms vessel or vase 100 are used synonymously throughout this document and are used to describe the cemetery flower vessel. The image art displayed upon the image display platform can be photographic, video or take any other form appropriate. The terms image art or images 11 are used synonymously throughout this document to describe this art. The vase 100 and or its mounting 101 will serve as an attachment point for the adapter embodiments. The image display platform embodiments will connect to the cemetery monument through the use of these adapters. Adapter embodiments can allow the attachment of the image display platform to an existing vase 100 and or mounting 101, this through the use of a custom designed adapter. The adapter embodiments disclosed here consist of designs intended to fit some or all of the many and various types of cemetery vase 100 and mounting 101 arrangements that are present in the cemetery environment. The adapter can be decorative in nature and have provisions for additional decoration types such as artificial flowers, emblems, logos, flags, balloons, whirligigs and other decoration types found in the cemetery environment. The adapter can also incorporate religious icons such as crucifixes and rosaries et cetera. Image display platform embodiments disclosed attach to the adapters disclosed. Drawings used to assist in visualization with this detailed description contain some similar reference characters that denote similar elements that carry through in multiple views.

Figure 2:
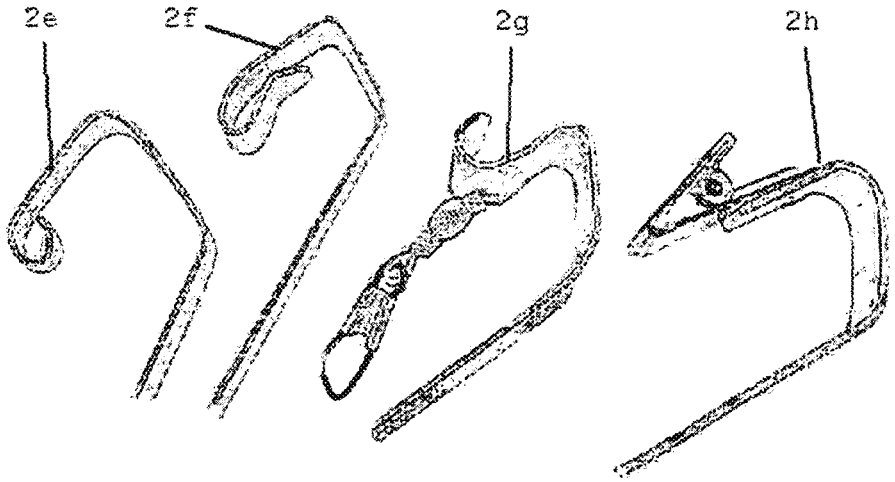
FIG. 2 is a right partial view of an assemblage of some of the various types of tab 2 in accordance with this embodiment.
Figure 3:
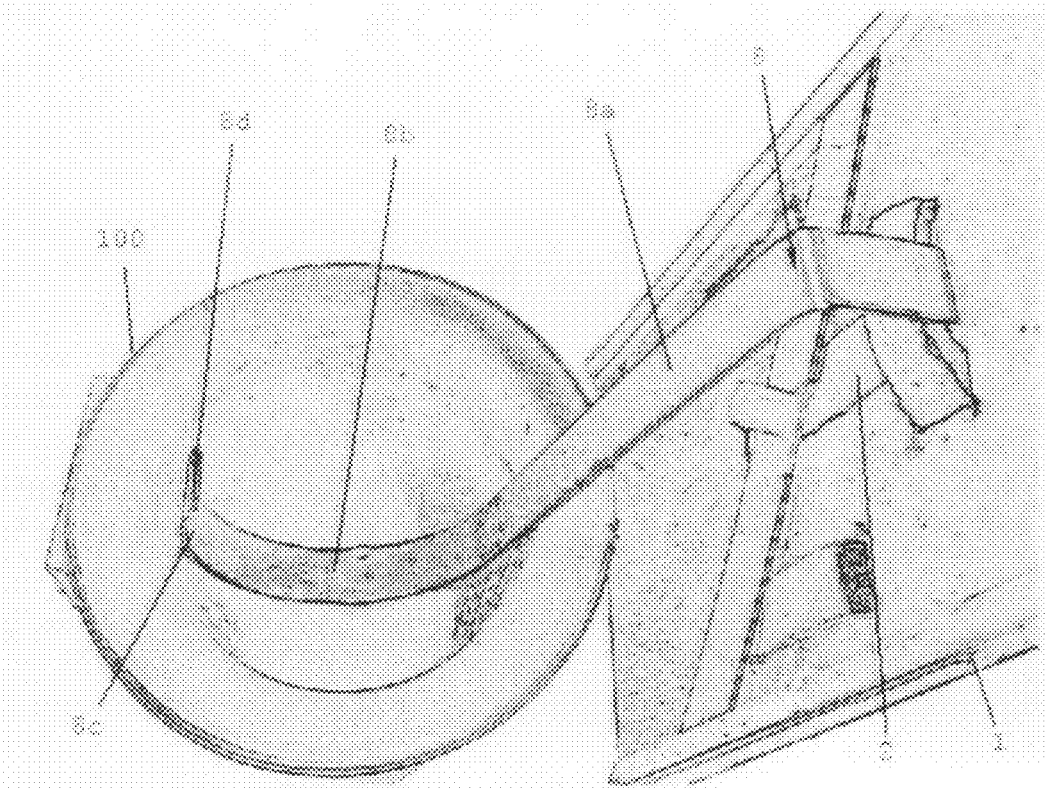
FIG. 3 is a top elevation view of an insert adapter 8 being inserted into vase 100 in accordance with this embodiment.
Figure 4:
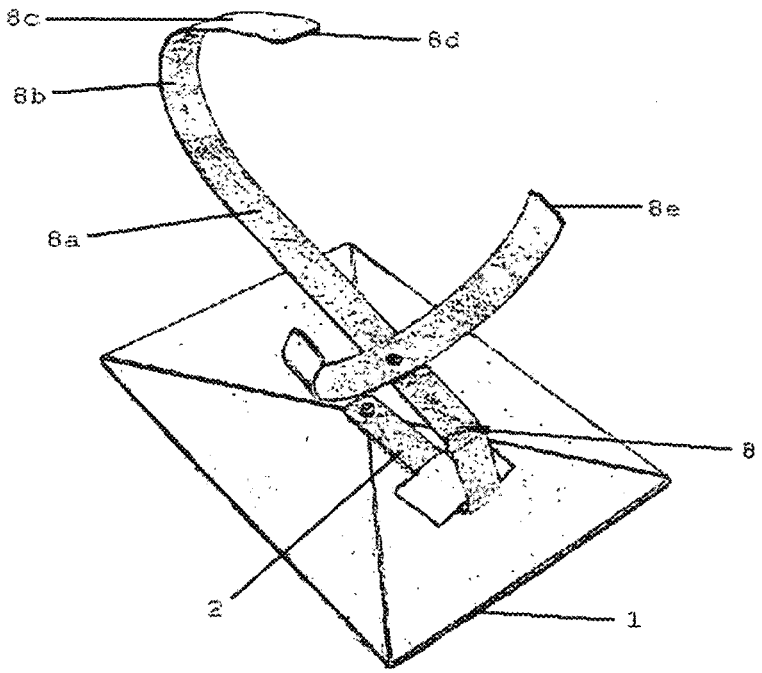
FIG. 4 is a right perspective view of an insert adapter 8 attached to rigidly mounted 1 and one location for item 8*e* in accordance with this embodiment.
Figure 5:
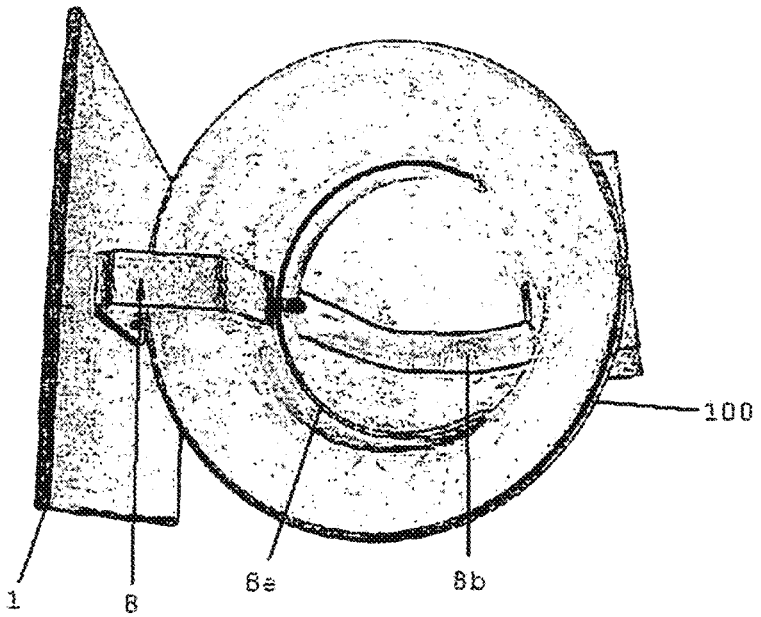
FIG. 5 is a top perspective view of an insert adapter 8 fully inserted into vase 100 with rigidly mounted 1 attached, this in accordance with this embodiment.
Figure 6:
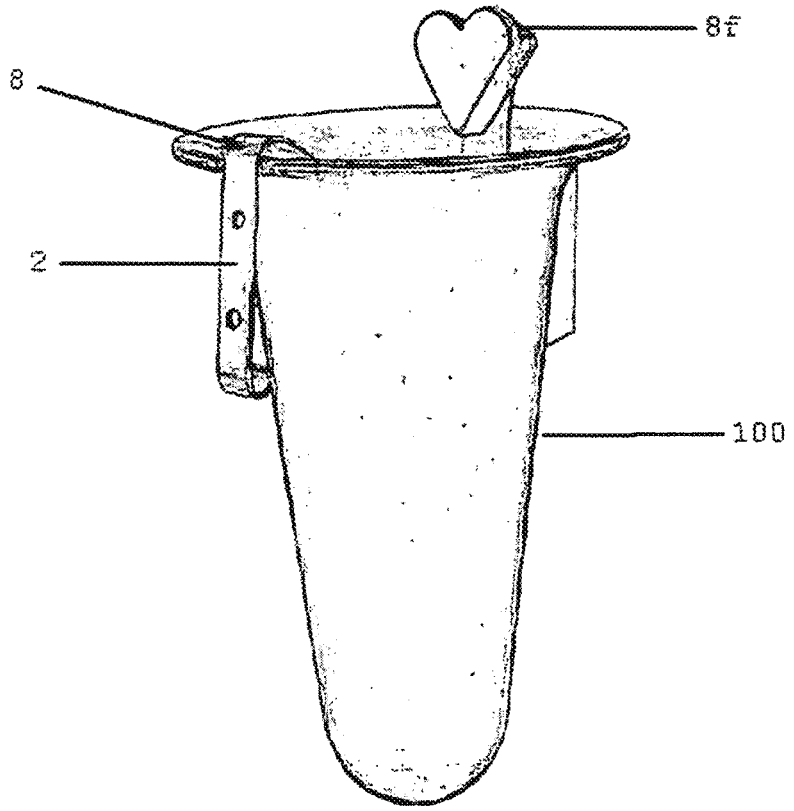
FIG. 6 is a front perspective view of an inserted adapter 8 inserted into vase 100 in accordance with this embodiment.

We will start by focusing on adapter embodiments. FIGS. 1, 2, 3, 4, 5 and 6 show an adapter embodiment that attaches to a cemetery monument by being inserted into the monuments flower vessel or vase 100. This embodiment is referred to as Inserted Adapter or IA 8 for brevity. IA 8 is created using tools found in the sheet metal and machine trades. FIG. 1 shows that this embodiment of IA 8 consists of a custom formed, shaped, cut, punched and bent, piece and or pieces of 20 gauge aluminum strip material (2024 alloy) one half inch in, width. Material selection is provided for example only. The material is initially formed to create a downwardly bent tab 2 feature. Tab 2 is used as an attachment point for joining an image display platform to IA 8. Tab 2 can feature one or more attachment holes 4 that can be round and or slotted to allow for adjustment. Holes 4 are sized to accept appropriate fastening devices. Holes 4 are positioned in tab 2 to correlate with attachment features located in the image display platform embodiment RM 1. RM 1 is shown in this example to help conceptual visualization. Image display platform embodiments RM 1, FF 33 and CS 44 can connect to IA 8. These embodiments are described elsewhere in this document. FIG. 2 shows views of truncated versions of IA 8 highlighting four variations of tab 2. Tab 2 can alternately incorporate a rolled 2*e* clasp or hooked 2*f* clasp. Tab 2 can have features attached to it such as swiveled clips 2*g* or clasp clips 2*h*. These shapes and features allow the attachment and retention of image display platform embodiments FF 33 and CS 44. Holes 4, shapes, features and attachment methods can be combined in any combination to create universality. IA 8 and tab 2 will not be limited to these few examples. FIGS. 3, 4 and 5 depict the general construction of IA 8 and also show its connection to RM 1. As the material that comprises IA 8 proceeds from tab 2, the material is formed to follow the contour of the rim and or top opening of vase 100. From there the material is again bent downwardly creating descending member 8*a*, which is formed to follow the internal bore of vase 100. As the material approaches the bottom of the bore of vase 100 it is then radiused in an upward direction. The material continues to follow the opposite side of the bore of vase 100 in an upwardly and opposite direction to the materials initial downward path creating ascending member 8*c*. At time of manufacture the bottom radiused portion 8*b* is formed so that the angle created between descending member 8*a* and ascending member 8*c* is greater than the angle and or span diameter of the bore of vase 100. When IA 8 is pushed downwardly into the bore of vase 100, IA 8 will try to expand or return to its original shape or span. This contraction and confined expansion creates stored forces in descending member 8*a* and ascending member 8*c*. This stored force is exerted outwardly and engages IA 8 descending member 8*a* and ascending member 8*c* firmly against the inner walls of vase 100. FIGS. 3 and 5 specifically show the connection between IA 8 and vase 100. The tip of member 8C can have a slight tip bend 8*d*, this to assist in removal. Ascending member 8*c* can terminate some where in the vases bore or can continue out of the opening of vase 100. By continuing out of vase 100, ascending member 8*c* can provide an attachment point for added decorative features 8*f*. FIG. 6 shows IA 8 installed in vase 100 with tab 2 ready to accept RM 1, decorative features 8*f* is also shown. Decorative features 8*f* can act as an attachment point for the aforementioned cemetery decoration types. Decorative features 8*f* size and shape will not be limited to this example. Returning to FIGS. 1, 4 and 5, an additional piece or pieces of formed material 8*e* is shown. Formed material 8*e* is shaped to incorporate the same aforementioned radius and angular stored forces used elsewhere in IA 8. Formed material 8*e* is a modified version of radius 8*b*, with features 8*a* and 8*c* shortened. Formed material 8*e* will also exert its force against the walls of the bore of vase 100. Formed material 8*e* is added to brace or assist in centering and retaining IA 8 in vase 100. Formed material 8*e* can be connected to IA 8 with a screw, rivet or other standard fastening method. One or more examples of formed material 8*e* can be added as needed to IA 8. Formed material 8*e* can be placed anywhere along the length and or width of IA 8. Formed material 8*e* can be removed or rotated for flat shipment and or storage. Formed material 8*e* can lock in place for shipment and or when in use. Formed material 8*e* could also be incorporated at the time of manufacture. Though not foldable, it would create a one-piece design. Weight, mass or other means can also be employed if needed to aid in retaining IA 8 to vase 100. Other IA 8 retention forces involved but not limited to are spring forces, friction and gravity. Any and all surfaces and areas of IA 8 that contact vase 100 can be treated in a way that will assist and improve retention capabilities. These treatments can include but are not limited to attachments affixed, forms created or coatings applied. IA 8 can be decorated in any way that will make it aesthetically pleasing and improve its longevity. These to include but are not limited to plaiting, painting, etching and engraving. The embodiment is compact, minimally invasive and still allows the vessel to be fully used for floral displays. The material comprising IA8 could alternatively be used to construct a lawn stake design. (Not shown)

To use IA 8, the corresponding image display platform is attached. The radiused end 8B of IA 8 is placed into the opening of vase 100. IA 8 and the image display platform are then oriented. IA 8 is then pushed down into the bore of vase 100. If required, the installer can manually form IA 8 to fit the bore of vase 100. IA 8 can also be manually formed to set the viewing angle of the image display platform. If present, the added brace or braces formed material 8*e* can be tucked into the bore as IA 8 is pushed into vase 100. Removal is accomplished by pulling up on IA 8 to remove it from vase 100.

Figure 7:
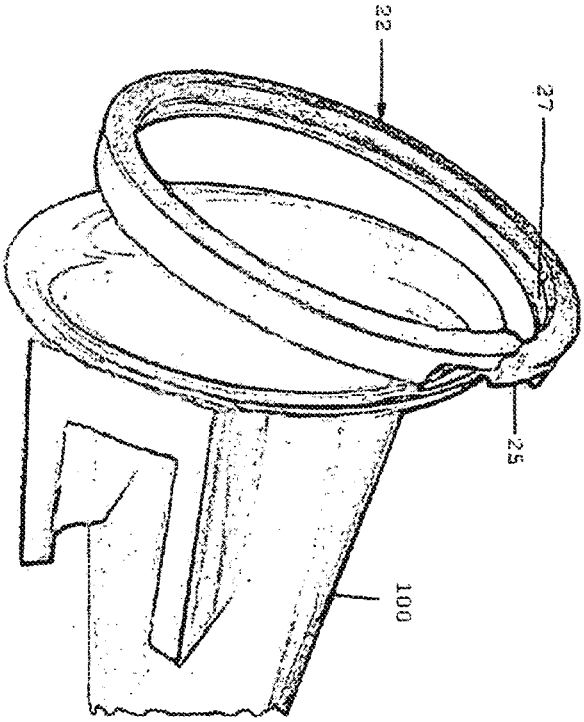
FIG. 7 is a rear perspective view of a vessel rim adapter 22 showing the ring portion placed on the rim of vase 100 in accordance with this embodiment.
Figure 8:
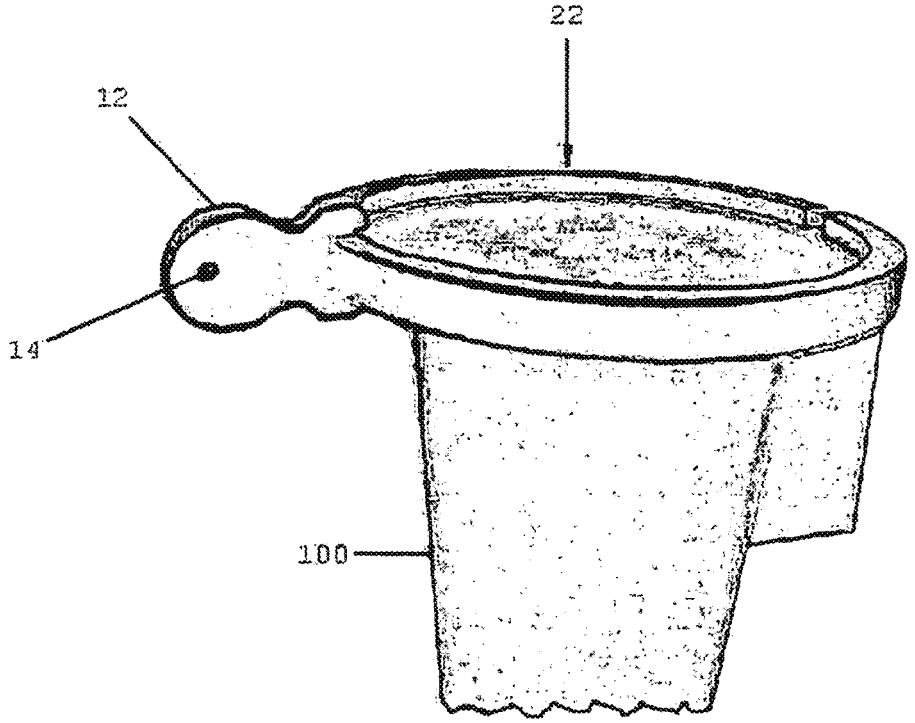
FIG. 8 is a left perspective view of a vessel rim adapter 22 installed onto vase 100 in accordance with this embodiment.
Figure 9:
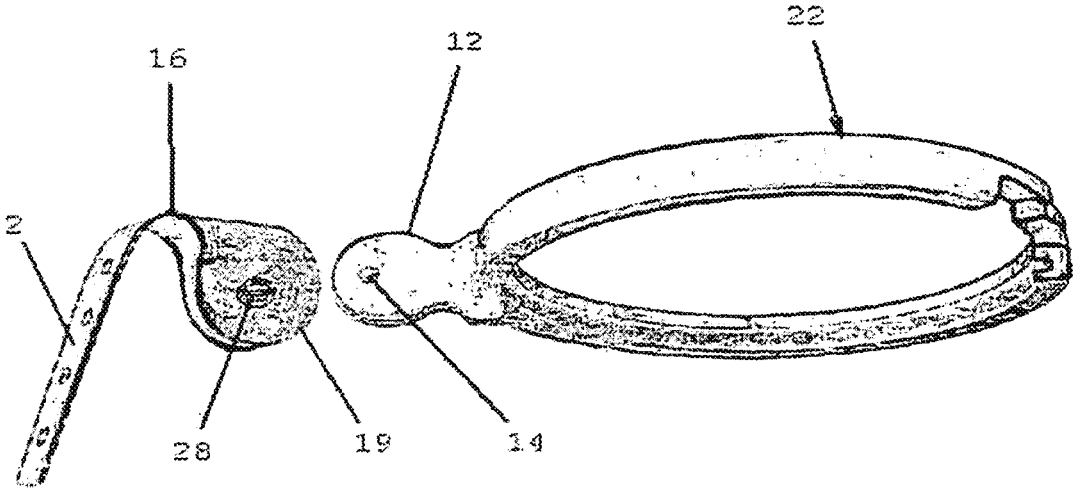
FIG. 9 is an assembly view of a vessel rim adapter 22 and display adapter in accordance with this embodiment.
Figure 10:
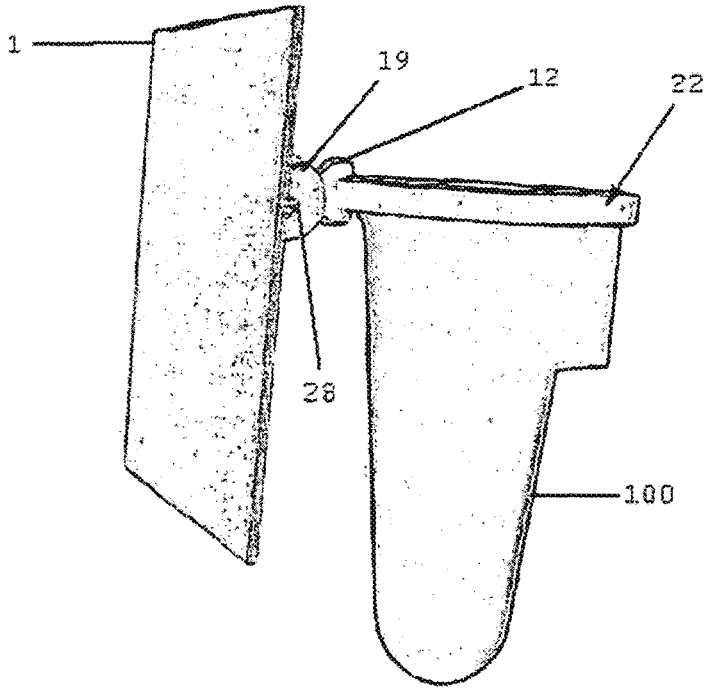
FIG. 10 is a left perspective view of a vessel rim adapter 22 without image and decorative frame installed in accordance with this embodiment.
Figure 11:
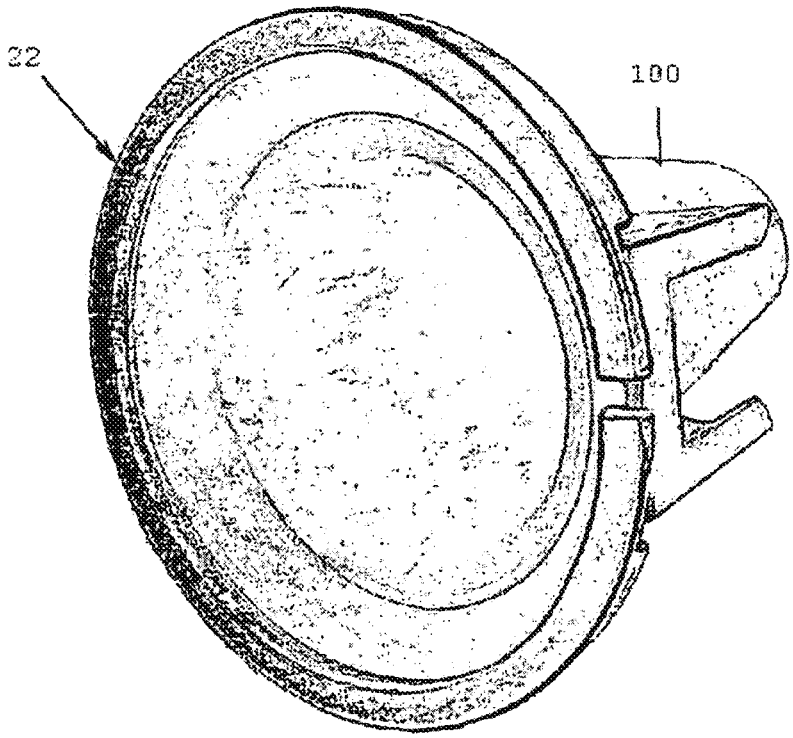
FIG. 11 is a top perspective view of a ring portion of vessel rim adapter 22 showing its attachment to a vase in accordance with this embodiment.
Figure 12:
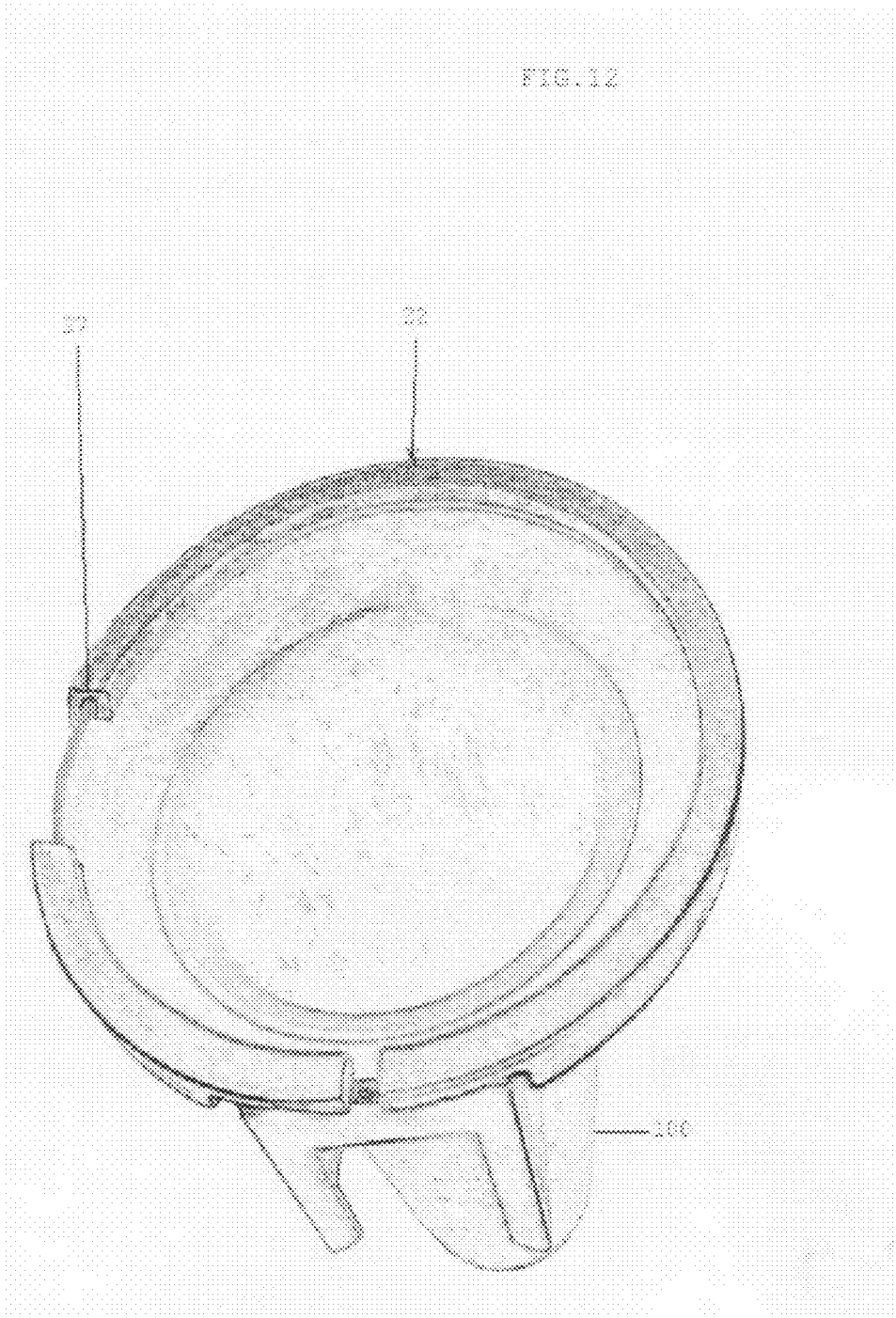
FIG. 12 is a top cut away view of a vessel rim adapter 22 ring with a section removed to reveal its attachment to the vase in accordance with this embodiment.

FIGS. 7, 8, 9, 10, 11 and 12 show a Vessel Rim Adapter embodiment or VRA 22 for brevity. VRA 22 can be constructed of a plastic (acetyl) material that is custom formed and or molded. For clarity, FIG. 7 shows only the ring portion of VRA 22, as it is being snapped or stretched onto and over the rim of vase 100. Also shown in this view is that the ring portion of VRA 22 possesses a radially running internal groove 27 at its center. Groove 27 is shaped or formed to fit onto the outer most lip or rim of vase 100. When VRA 22 is manufactured, groove 27 will be made somewhat smaller in diameter then the outer most diameter of the rim of vase 100. VRA 22 can be somewhat elastic in nature. When VRA 22 is placed on or stretched over the rim of vase 100, VRA 22 will try to contract to its original size. This contracting force holds VRA 22 tightly on the rim of vase 100. VRA 22 can be split or solid. To keep VRA 22 orientated on vase 100 a notch 25 can be cut or molded into VRA 22. Notch 25 can correlate with the size and location of the mount provision provided for vase 100. VRA 22 can be heated to assist in installation. VRA 22 also can have a setscrew or screws and or other locking and or locating means added (not shown). VRA 22 will have a boss 12 created when VRA 22 is manufactured. Boss 12 is provided as a connection point for an image display platform. FIG. 8 shows boss 12 and its connection to VRA 22. Boss 12 extends a distance from the center of vase 100. This distance will be sufficient to allow for the attachment of image display platforms. Boss 12 has a boss hole 14 at or near its center. The image display platform is connected to boss 12 through a bracket 16. FIG. 9 shows the relationship between boss 12 and bracket 16. Bracket 16 is custom formed from aluminum sheet (2024) alloy 0.040 in thickness. Bracket 16 can have two opposing ears 19. Opposing ears 19 each have a hole that passes through their center. When formed, opposing ears 19 are aligned. Bracket 16 is placed on to boss 12 with opposing ears 19 cradling boss 12. Fastener 28 is passed through the hole at the center of opposing ears 19. The fastener 28 also passes through boss hole 14, joining bracket 16 to VRA 22. Fastener 28 is tightened causing opposing ears 19 to contract griping boss 12. Fastener 28 can be a bolt, pin or rivet, et cetera. Bracket 16 will incorporate one or more incarnations of attachment tab 2. FIG. 10 shows VRA 22 with an Image display platform attached and the assembly installed on vase 100. FIG. 11 shows the ring portion of VRA 22 seated on the rim of vase 100. FIG. 12 shows a cut away view of the ring portion of VRA 22 cut away. Groove 27 is shown fully engaging the rim of vase 100. Bracket 16 and fastener 28 can be decorated and or be decorative in nature. VRA 22 can also be decorated in any fashion already disclosed in this document. Ring portion only views are provided to simplify and aid with visual clarity.

One method of using VRA 22 is for the user to install the preferred image display platform to bracket 16. Bracket 16 is slipped onto boss 12 and secured with fastener 28. VRA 22 is then installed on the rim of vase 100 and is ready for use. Remove and disassemble by reversing this process.

Figure 13:
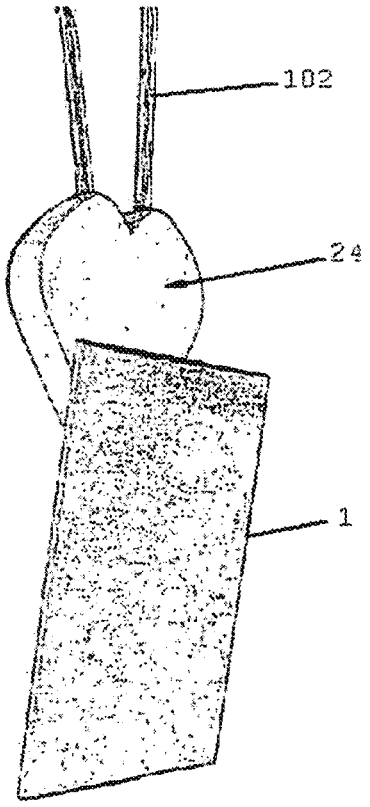
FIG. 13 is a front perspective view of a vessel mount adapter 24 vertically mounted with display and decoration in accordance with this embodiment.
Figure 14:
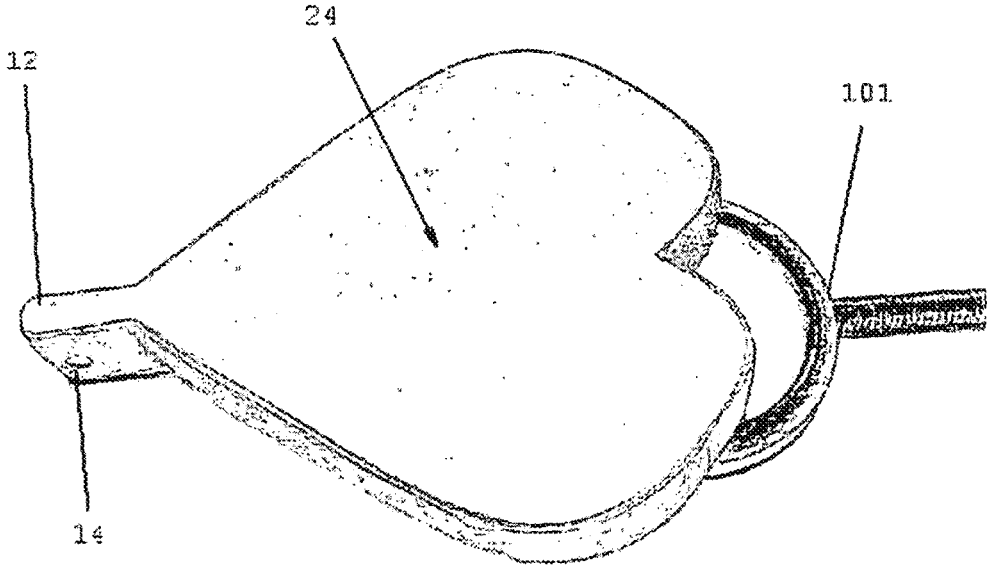
FIG. 14 is a top perspective view of an interaction between vessel mount adapter 24 and the mount and is in accordance with this embodiment.
Figure 15:
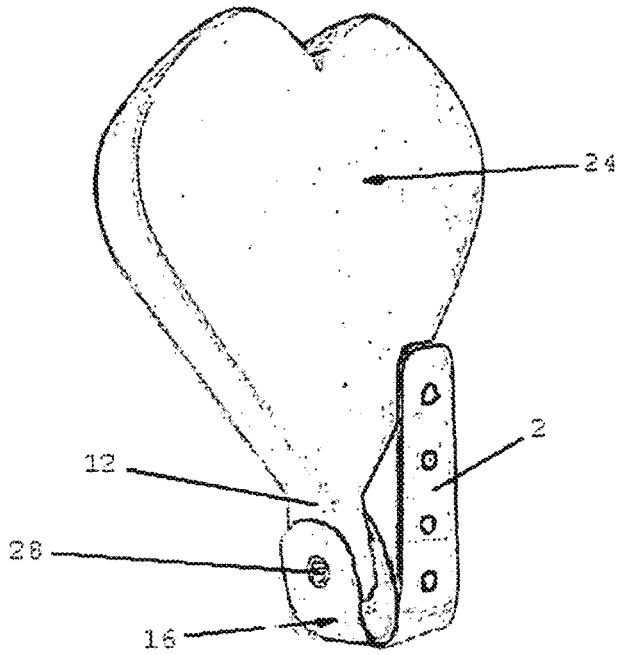
FIG. 15 is a front perspective view of a vertically mounted vessel mount adapter 24 with adapter bracket in accordance with this embodiment.
Figure 16:
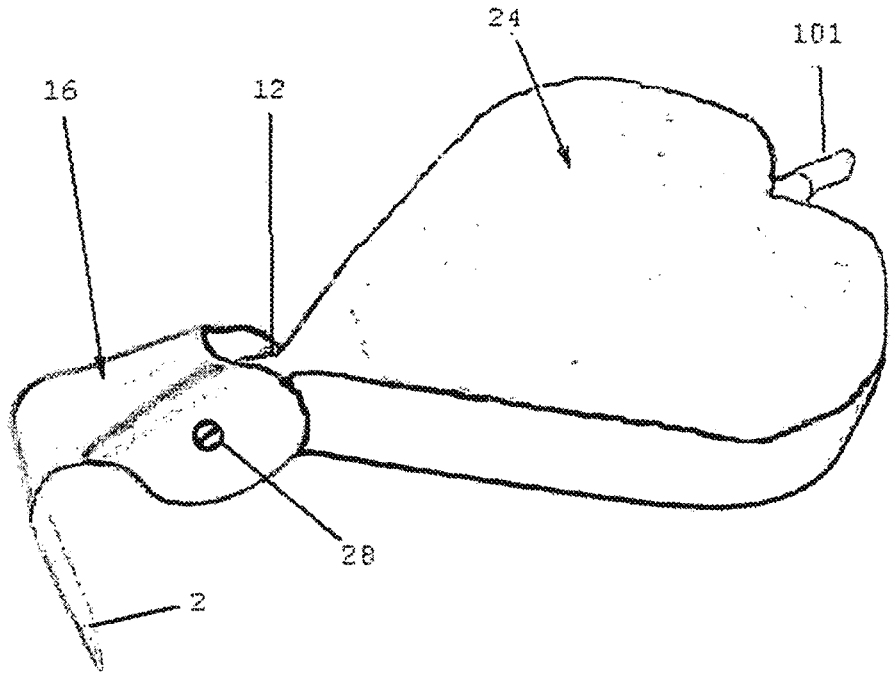
FIG. 16 is a top perspective view of a horizontally mounted vessel mount adapter 24 with adapter bracket in accordance with this embodiment.

FIGS. 13, 14, 15 and 16 show a Vessel Mount Adapter embodiment or VMA 24 for brevity. VMA 24 will offer the consumer different options. FIG. 13 shows VMA 24 mounted vertically with image display platform RM 1 and decorations 102 installed, this, as it would appear in use. VMA 24 will attach directly to a cemetery monument flower vessel mount. There are many styles and types of cemetery flower vessel mountings used in the cemetery environment both vertical and or horizontal. VMA 24 can slip, clip, snap, entrap, in, on, over, around, inside or outside of the various types of mountings (features not shown). FIG. 14 shows VMA 24 slipping over one example of a horizontal mounting 101. Also shown are features boss 12 and boss hole 14. Boss 12 and boss hole 14 will be located a distance from the center of VMA 24. This distance will be sufficient to allow the attachment of an image display platform. VMA 24 can be made of a molded plastic material (PVC). VMA 24 can be springy in nature so it can be stretched over mounting 101. VMA 24 can be rigid in nature and have spring-loaded or tensioned features to grip mounting 101 (feature not shown). VMA 24 can plug into or cover mounting 101 completely and can be retained by an expanding plug section or other mechanical means (features not shown). FIG. 15 shows VMA 24 connected to a vertical vessel mount. Bracket 16 is shown attached to boss 12 secured by fastener 28. Also shown is tab 2. FIG. 16 shows VMA 24 connected to a horizontal mounting 101. Bracket 16 is shown attached to boss 12 secured by fastener 28. Tab 2 is also shown. VMA 24 can cover the existing opening of mounting 101. VMA 24 can be used with or without using vase 100. Vase 100 can be used if an opening is provided in VMA 24 (not shown). Vase 100 can serve to retain VMA 24 to mounting 101 by passing through VMA 24 and into mounting 101 (interaction not shown). As described earlier in this document VMA 24 can be decorative in nature, VMA 24 can encompass any physical shape and be sized as needed for use with a particular vessel mount. VMA 24 can support the display of various cemetery decoration types and religious icons. VMA 24 can have boss 12 and or other means to facilitate the attachment of image display platforms described in this document. These include but are not limited to bracket 16 secured to boss 12 by fastener 28.

To use VMA 24, its installation will depend on the type of flower vessel mount that is present at the deceased's monument. An image display platform embodiment is attached to VMA 24 through the use of corresponding bracket 16 and fastener 28. VMA 24 is then attached to the vessel mount in the fashion required to engage it to the mount.

Figure 17:
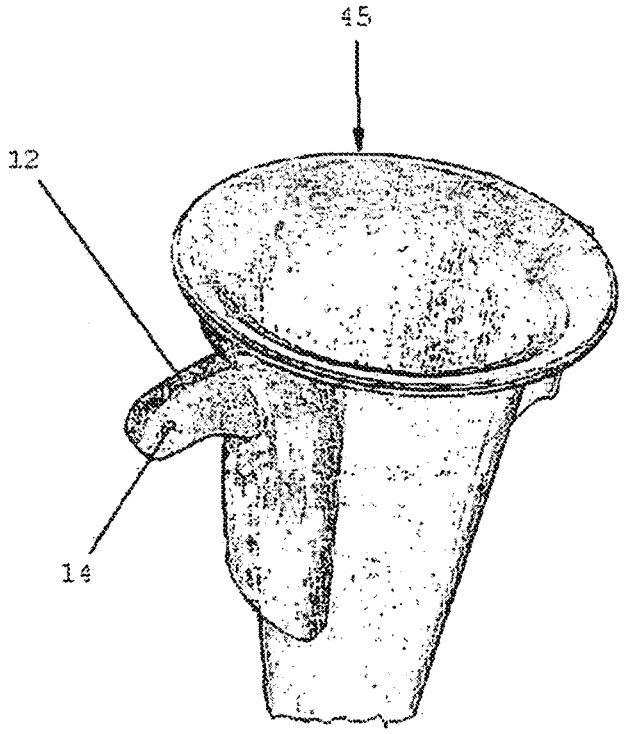
FIG. 17 is a top perspective view of a vase with boss design in accordance with this embodiment.
Figure 18:
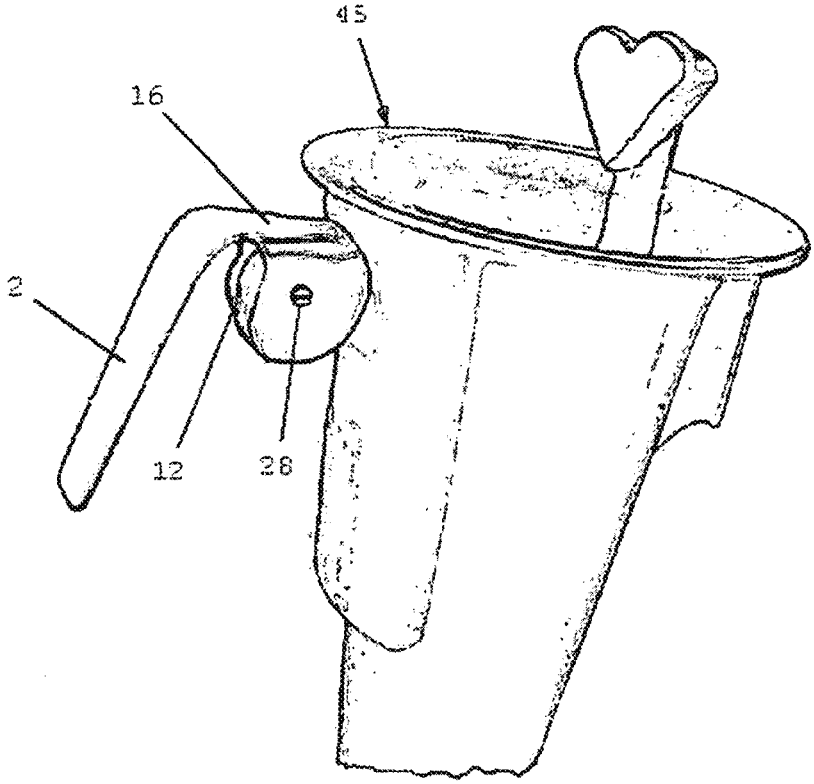
FIG. 18 is a left perspective view of a vase with boss and associated parts and is in accordance with this embodiment.
Figure 19:
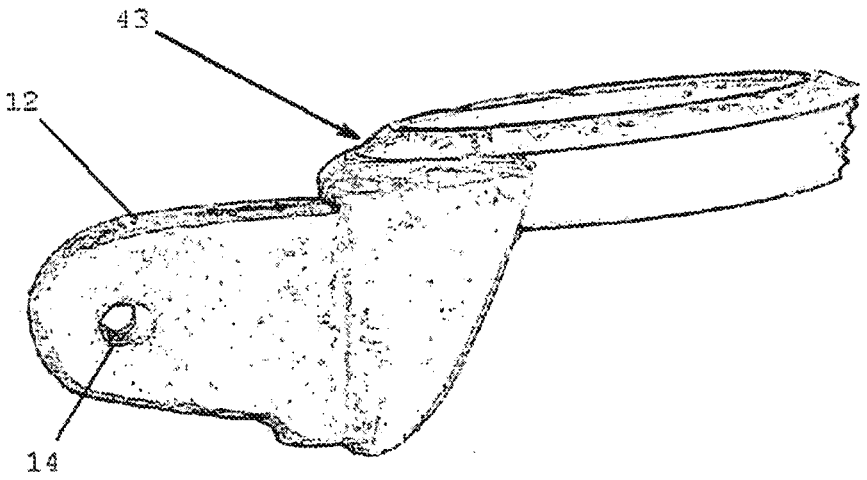
FIG. 19 is a left perspective view of a mount with boss in accordance with this embodiment.
Figure 20:
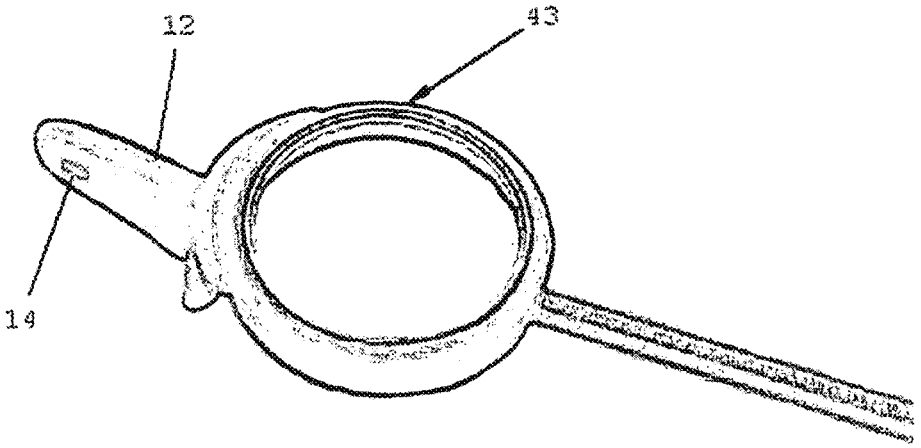
FIG. 20 is a top perspective view of a mount with boss and is in accordance with this embodiment.

FIGS. 17 and 18 show a Vase With Boss 45 embodiment. FIGS. 19 and 20 show a Mounting With Boss 43 embodiment. These embodiments incorporate an attachment boss 12 to the existing designs. The addition of boss 12 to these items constitutes a new use for these designs. Boss 12 is used to connect an image display platform to either embodiment. Boss 12 can be created and incorporated at the time of manufacture. Boss 12 can be singular or multiple. Boss 12 can be a permanent part of Vase With Boss 45 and or Mounting With Boss 43. Boss 12 can have boss hole 14 present. Boss 12 can have other assembly features (not shown). Boss 12 extends, and boss hole 14 is located a sufficient distance from the center of these embodiments to allow the attachment of an image display platform. FIG. 17 shows this relationship for the Vase With Boss 45 embodiment as boss 12 and boss hole 14 are shown. FIG. 18 shows the Vase With Boss 45 embodiment with bracket 16 attached to boss 12. Bracket 16 is secured to boss 12 with fastener 28. Tab 2 is also shown. FIGS. 19 and 20 shows this relationship for the Mounting With Boss 43 embodiment as boss 12 and boss hole 14 are clearly shown. An image display platform of choice is attached to boss 12. The attachment is made through the use of bracket 16. Bracket 16 unites Vase With Boss 45 and or Mounting With Boss 43 to an image display platform in the same manor employed in other embodiments. These means support the image display platforms connection to the cemetery monument through the adapter.

To use these adapter embodiments an image display platform is attached to tab 2 of bracket 16. FIG. 18 shows bracket 16 and its attachment to boss 12. Bracket 16 attaches to Vase with boss 45 or Mounting with boss 43 in the same fashion. Fastener 28 is inserted into bracket 16 and through boss hole 14 and tightened to secure the assembly.

Figure 21:
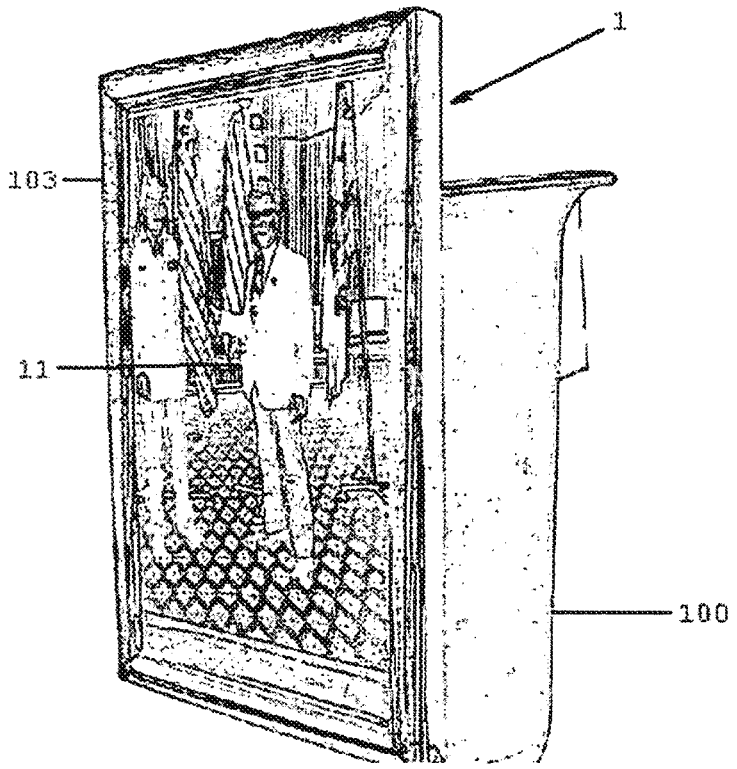
FIG. 21 is a front perspective view of an installed rigidly mounted image display platform 1 being used in accordance with this embodiment.
Figure 22:
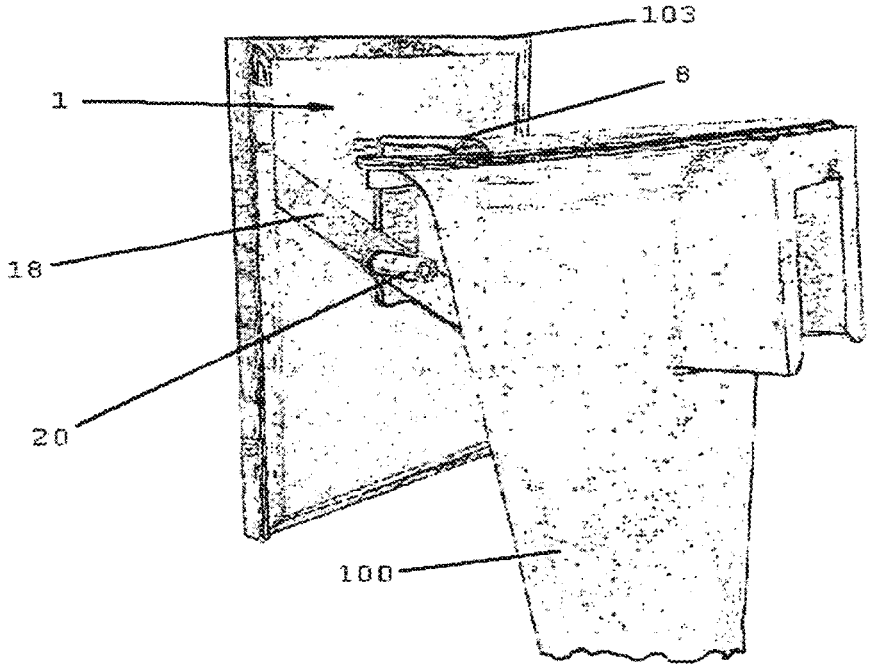
FIG. 22 is a rear perspective view of an installed rigidly mounted image display platform 1 in use in accordance with this embodiment.
Figure 23:
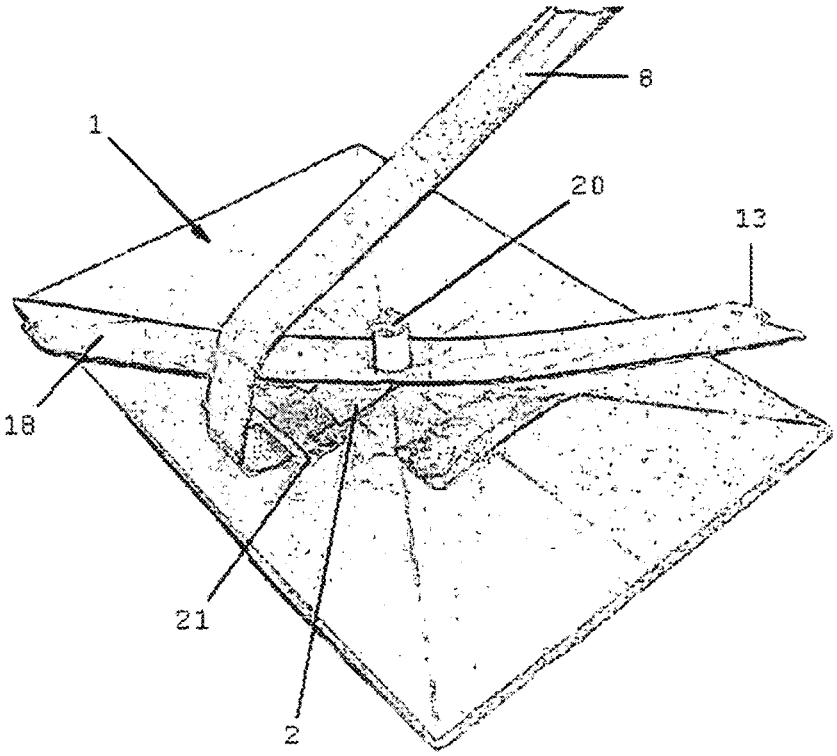
FIG. 23 is a rear perspective view of a rigidly mounted image display platform 1 with its frame removed to highlight crossbar, slots and adapter in accordance with this embodiment.
Figure 24:
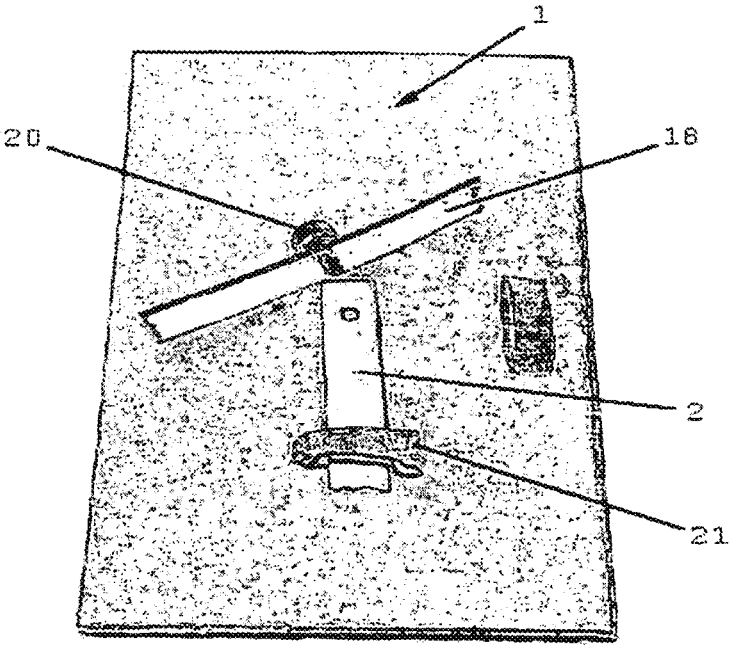
FIG. 24 is an assembly view of a rigidly mounted image display platform 1 with truncated parts to show interactions and connection in accordance with this embodiment.
Figure 25:
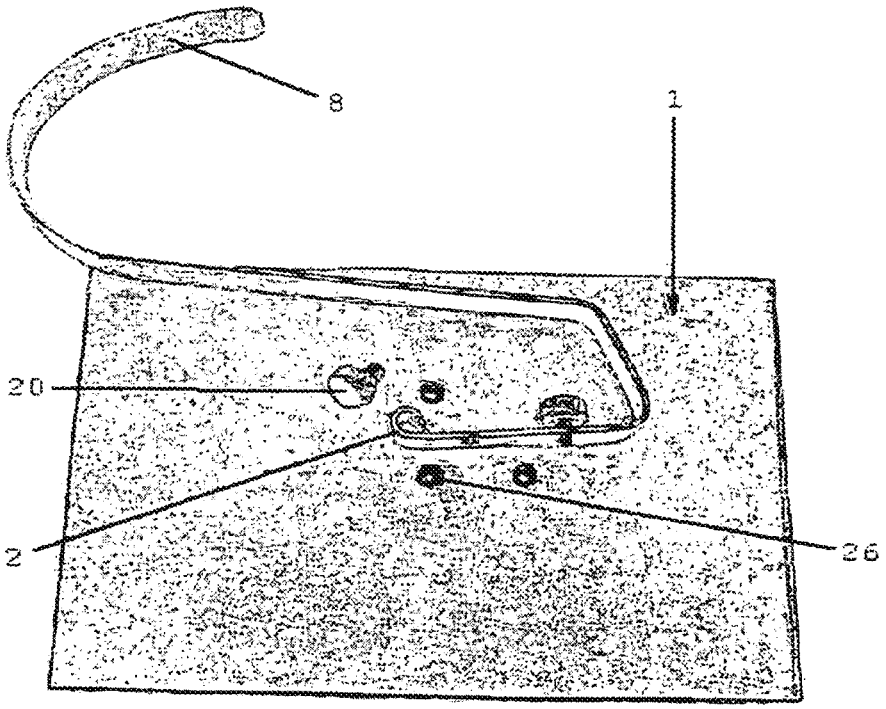
FIG. 25 is an assembly view of a rigidly mounted image display platform 1, fasteners and adapter 8 demonstrating interactions in accordance with this embodiment.
Figure 26:
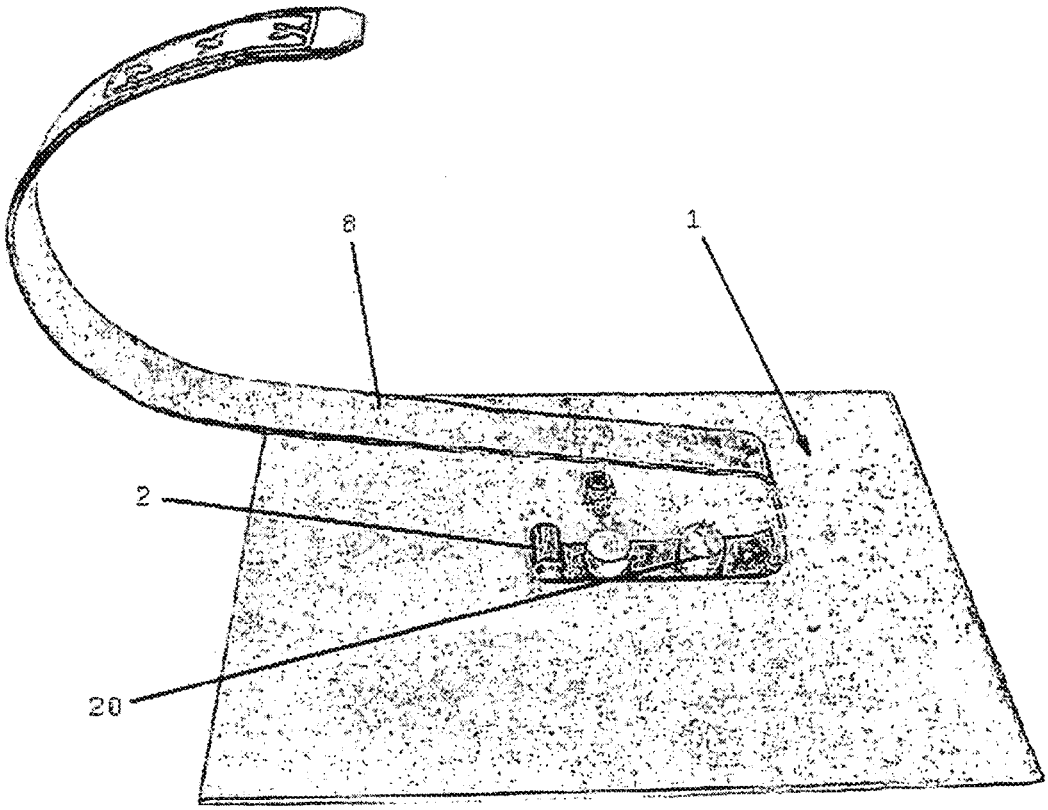
FIG. 26 is a left perspective view of a rigidly mounted image display platform 1 and the connection between it and adapter 8 in accordance with this embodiment.
Figure 27:
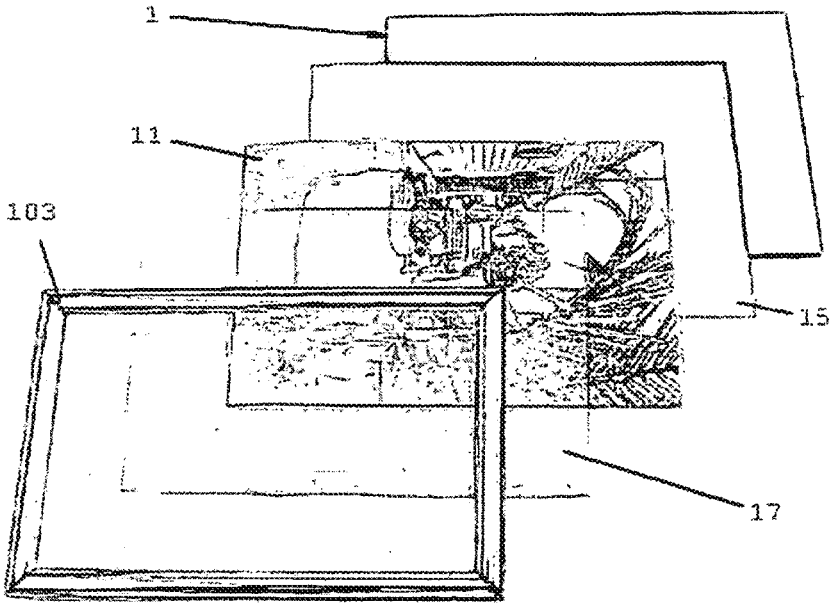
FIG. 27 is an assembly view of a rigidly mounted image display platform 1 showing the parts that make up its display side in accordance with this embodiment.

We will now switch our focus to image display platforms. FIGS. 21, 22, 23, 24, 25, 26 and 27 views show an image display platform embodiment that can be Rigidly Mounted or RM 1 for brevity. RM 1 can be constructed of plastic, resin impregnated paper product or other material. RM 1 consists of connectable platforms and or surfaces on which photographic and or other image art objects can be placed, affixed or attached. These image art objects will be referred to as images 11 in these embodiments. RM 1 will present images 11 in an attractive and eye pleasing way so that images 11 can be displayed in the cemetery environment. RM 1 can be connected to the cemetery monument through the use of an adapter or adaptation means. To assist with visualization we have chosen to show adapter IA 8 and its connection to RM 1 in this example. Be advised that RM 1 can be used with all adapters described in this document. These adapters and adaptation means are fully disclosed elsewhere in this document. RM 1 can incorporate and accommodate decorative frame or frames 103. These frame options will be referred to as frames 103 in these embodiments. RM 1 can accept standard, readily available store bought frames 103. RM 1 can be custom cut or formed so as to accept special shaped frames 103. RM 1 can be shaped to the desired form needed to fit any type of frames 103. RM 1 can be curved, wraparound, multifaceted or segmented to break to size. Frames 103 can be easily removed and installed to allow for the exchange of images 11. Frames 103 can be retained to RM 1 through the use of a radially formed bow spring tensioning crossbar 18. Multiple crossbars can be used if needed. FIG. 21 shows RM 1 installed, this as it would appear in use. FIG. 22 shows a rear view of RM 1, as it would appear in use installed on vase 100. Crossbar 18 is shown engaging frames 103 with fasteners 20 at its center. Fasteners 20 can be a screw or screws and or other standard fastening means. A small portion of IA 8 is also shown. FIG. 23 shows another rear view of RM 1 with frames 103 removed. The bowed shape of crossbar 18 can be seen in this view. Crossbar 18 can have at its tips a catch 13. Catch 13 engages the inner lip at the perimeter of frames 103. Catch 13 helps hold frames 103 securely to RM 1. Crossbar 18 will apply a pulling force to the perimeter of frames 103. Crossbar 18 is depressed and rotated to engage the perimeter of frames 103. Stored forces in crossbar 18 draw frames 103 and images 11 firmly against RM 1. Crossbar 18 can have a hole at or near its center to accommodate fasteners 20. Fasteners 20 can be used to connect crossbar 18 to RM 1. After passing through crossbar 18, fasteners 20 can also pass through holes 4 in tab 2 of adapter IA 8. Fasteners 20 can connect both crossbar 18 and IA 8 to RM 1 simultaneously. RM 1 will display images 11 in either portrait and or landscape configurations. Slotted protruding projections having slots 21 are used for this purpose. FIG. 24 shows RM 1 with slots 21 shown. Slots 21 are placed a sufficient distance from the center of RM 1 to allow assembly. Slots 21 are usually spaced 90 degrees apart. Slots 21 are usually aligned with the top and or bottom and right and or left edge of RM 1. Slots 21 can be solid as shown. Alternatively one side of slots 21 can be open or a section of the middle portion can be removed. These alterations are made to allow features to pass through slots 21. Also shown are fasteners 20, crossbar 18 and tab 2. Crossbar 18, and the tab 2 portion of adapter IA 8 have been truncated for clarity. Fasteners 20 is shown passing through crossbar 18. Tab 2 can be seen passing into and through slots 21. A threaded inserts 26 can be installed in RM 1 to accept fasteners 20 (insert is obstructed in this view). Inserts 26 can be located at or near the center of RM 1. Adapter IA 8 and crossbar 18 can be secured to RM 1 when fasteners 20 is threaded into inserts 26. FIGS. 25 and 26 show an alternate orientation method using multiple threaded inserts 26 and eliminating slots 21. FIG. 25 shows strategically located threaded inserts 26 and or other attachment means placed, created and or inserted into RM 1. One inserts 26 can be located at or near the center of RM 1. Two others inserts 26 can be located a distance from the center of RM 1. These two inserts 26 are usually spaced 90 degrees apart and each aligned with a different edge of RM 1. Also shown are adapter IA 8, tab 2 and fasteners 20. FIG. 26 shows adapter IA 8 attached to RM 1. Fasteners 20 are inserted into the attachment holes 4 that are located in tab 2 of adapter IA 8. Fasteners 20 are threaded into inserts 26 connecting RM 1 to adapter IA 8. These adapter attachment points can be incorporated into RM 1 when it is manufactured and or added later as needed. FIG. 27 shows the items that make up the display side of RM 1. A layer of adhesive backed plastic material or surface 15 can be placed onto the front or viewing area of RM 1. Surface 15 can create a smooth surfaced platform on which to mount images 11. Surface 15 can support the attachment of custom made stick-on or sticker style photos and or images 11. Surface 15 can be printed with a stock image or advertisement. Surface 15 can have a gradient or grid to assist with alignment of images 11. Non self-adhering items can be secured to surface 15 by using two-sided adhesive tape and or other means. Non-adhesive backed images 11 can be laminated before being attached to RM 1. Surface 15 could also have magnetic properties. Once images 11 are attached to RM 1 a clear cover 17 can be added. Clear cover 17 can be an optically clear plastic sheet. Clear cover 17 could be tinted and or provide UV protection. Clear cover 17 could have a decorative ghost image printed on it. Clear cover 17 tops the image and protects it from the elements. Glass can be substituted but its use is discouraged due to breakage hazards. Frames 103 can then be placed on or over RM 1 and retained to it by crossbar 18 and fasteners 20. If greater force is needed to contain and or retain frames 103, spring clips, edge deformations or other standard means can be added (not shown). These embodiments are not limited to these types of aforementioned materials, assembly, attachment and orientation methods. They are provided as examples only.

To use this embodiment of the image display platform the user will decide if the image is to be displayed in portrait or landscape mode. Once orientation is chosen, RM 1 is attached to the adapter using the orientation attachment provision. The center retaining fasteners 20 is passed through crossbar 18 and tab 2 of the adapter. Fasteners 20 is then loosely threaded into center inserts 26 on the backside of RM 1. RM 1 is turned over so that the display side faces the installer. The installer can then attach the images 11 to surface 15 of RM 1, place clear cover 17 over images 11 and slip frames 103 on or over the assembly. The assembly is again rotated with the back of RM 1 facing the installer. Crossbar 18 is depressed and rotated until its tips are fully set under the edges of the frames 103. Fasteners 20 is then tightened fully and if a second fasteners 20 is used, it is aligned, inserted and tightened. With assembly completed, RM 1 and adapter are ready to be installed in or on the cemetery vase 100 or mounting 101. Reversal of this procedure is used to remove or replace the image.

Figure 28:
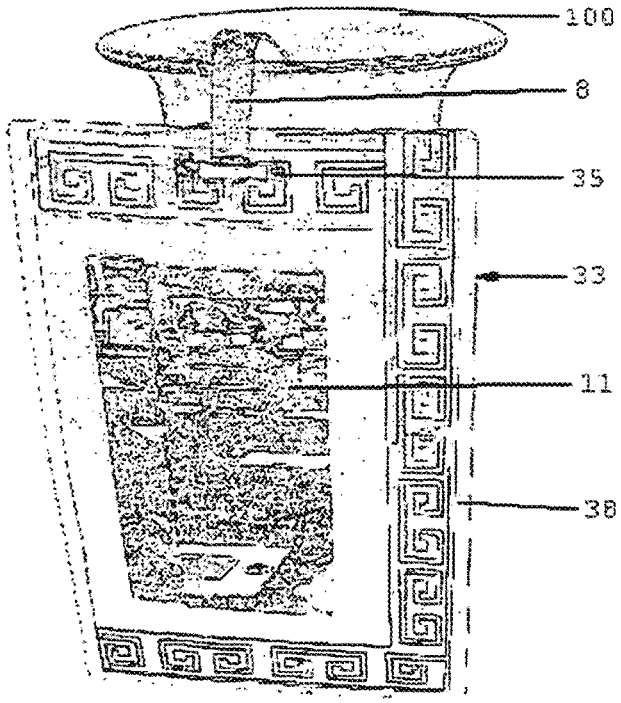
FIG. 28 is a front perspective view of a free form image display platform 33 in use and in accordance with this embodiment.
Figure 29:
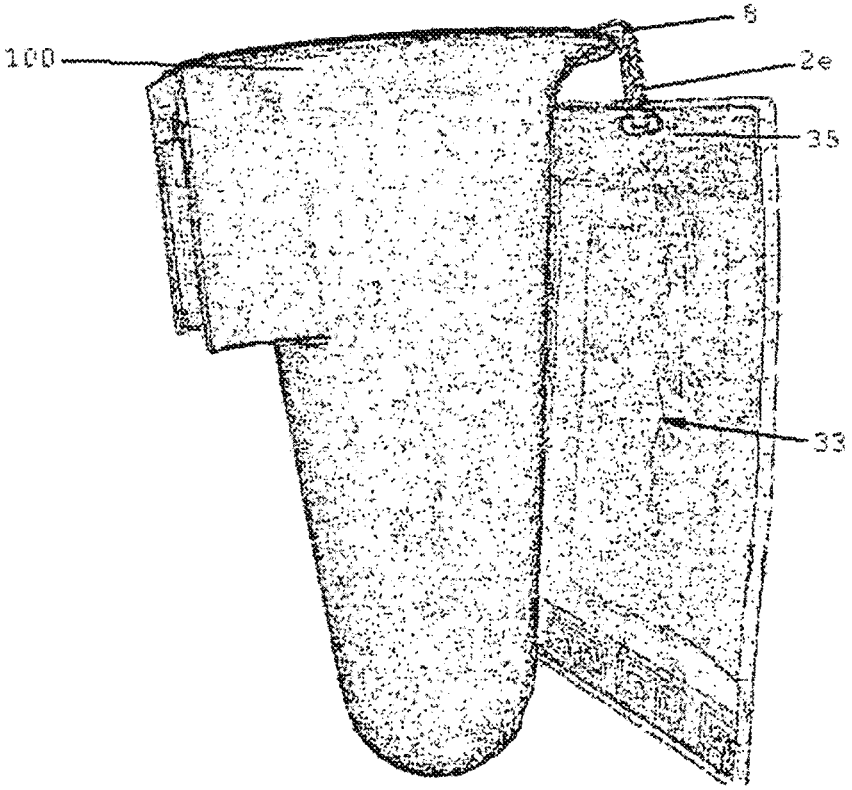
FIG. 29 is a rear perspective view of a free form image display platform 33 in use and in accordance with this embodiment.
Figure 30:
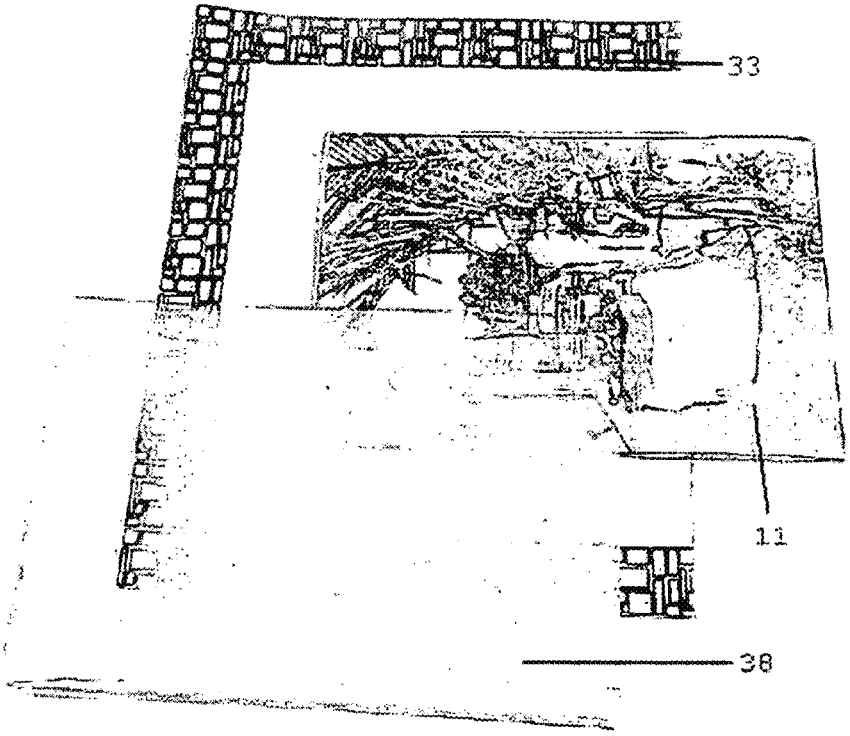
FIG. 30 is an assembly view of a free form image display platform 33 in accordance with this embodiment.

FIGS. 28, 29 and 30 views show a custom made Free Form display platform embodiment or FF 33 for brevity. FIG. 28 shows a front view of FF 33 when in use. As in previous embodiments, adapter IA 8 will be shown in this example to assist in visualization. FF 33 can also be used with any other adapter embodiment disclosed in these documents. Adapter IA 8 is shown installed in vase 100. FF 33 connects to adapter IA 8 through slot 35. Slot 35 is an attachment point for FF 33 connection to the adapter. The adapter connects FF 33 to vase 100. Images 11 is shown laminated to FF 33 using laminate material 38. FIG. 29 shows FF 33 in use viewed from the left rear. In this view you can see the interaction between the rolled 2*e* portion of tab 2 and slot 35 of FF 33. The rolled 2*e* portion passes through slot 35 keeping FF 33 secure to adapter IA 8. FF 33 can be oriented in either the portrait or landscape view. Placement location of slot 35 will properly orientate the view of FF 33. Slot 35 can be incorporated at time of manufacture. If FF 33 is laminated, the laminate can be punched to create slots 35. A slotting tool used in the creation of ID badges can be used to fabricate slot 35. An eyelet or eyelets can also be substituted as an alternative attachment method (not shown). Laminate material 38 is punched and an eyelet is installed using the required tooling. As shown in FIG. 30, assembly view, FF 33 can be constructed of a thin semi rigid sheet of plastic, paper or other material. FF 33 can have a decorative outer edge portion or border to simulate a frame or surround. FF 33 can have decorative front and or back surfaces. FF 33 can be placed beneath and or between photographs, artwork or other image types. FF 33 can be laminated to these image types using laminate material 38. FF 33 can be laminated using either hot or cold standard lamination methods. FF 33 can also have standard or custom made stick-on or sticker style photos or images 11 attached to it. FF 33 could also have magnetic properties. The FF 33 embodiment is free form and can flutter and or rotate in the breeze. Either side of FF 33 can be the foreground and or main display area. Other decoration or artwork can be added to the minor or background side of FF 33. These can include but are not limited to photos, images 11, names, poems, and QR codes, etc.

One method of using this embodiment of the image display platform follows. Both front and or rear surfaces of FF 33 can be populated with custom stickers, photos, images 11 and or other artwork. When decoration is complete the adorned FF 33 can then be laminated if necessary. An orientation direction is chosen for FF 33. If used, laminate material 38 is slotted and or punched and eyeleted to create an attachment point. Once an attachment point is created, FF 33 can be attached to the corresponding adapter and then installed in or on the cemetery vase 100 or mounting 101. The lamination methods used here are permanent.

Figure 31:
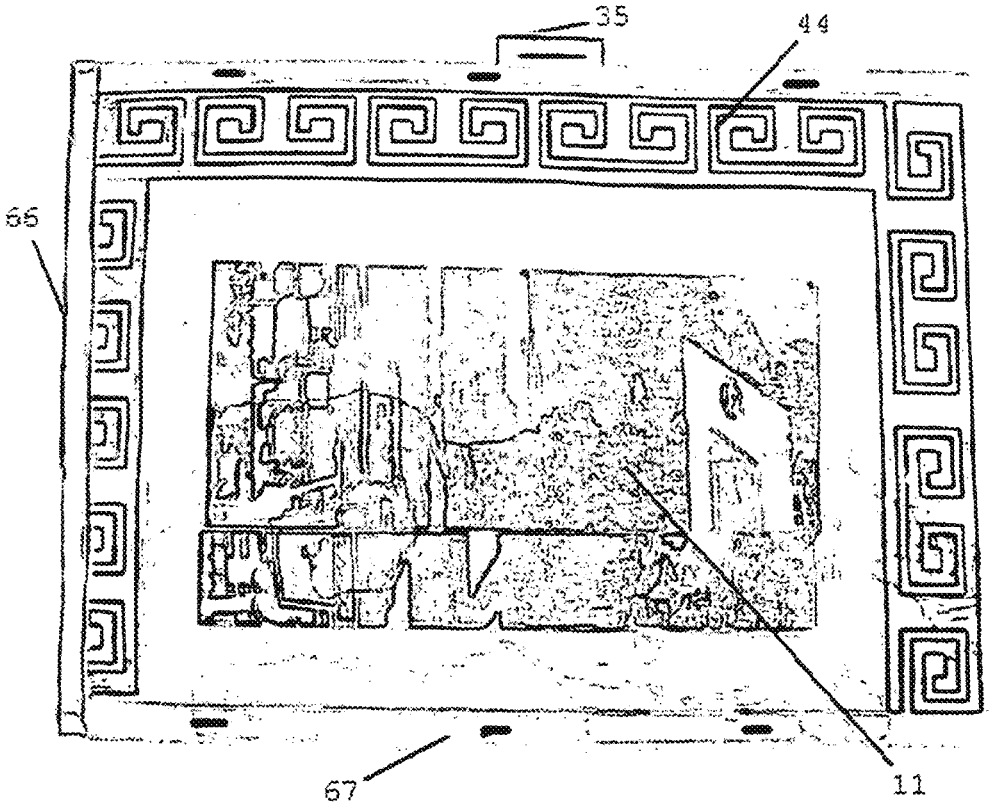
FIG. 31 is a front view of a clamshell image display platform 44 in accordance with this embodiment.

FIG. 31 shows a Clam Shell Style image display platform embodiment or CS 44 for brevity. There is nothing more ubiquitous to our retail culture then the lowly clamshell style blister package. Virtually any product imaginable can come trapped in one of these see through wonders. CS 44 is a new and different use for this type of packaging. CS 44 is a clamshell type package that could be shaped to replicate a store bought photo frame. Unlike the retail version, CS 44 has provisions to display images 11 and not products. CS 44 would be manufactured in similar fashion to millions of other clamshell style packages. CS 44 could be one piece in construction. FIG. 31 shows that CS 44 can have a flexible hinged 66 part connecting the front portion to the back portion. CS 44 could have formed pocket and protrusion snaps 67 located around the edge of the perimeter of the front and back portions. These snaps 67 would engage when closing CS 44 and hold it shut. Adhesive, glue or other means could also be used. When closed, CS 44 would retain images 11. As with all embodiments CS 44 can be decorative. A connection point or points can be created when CS 44 is die cut. These points will allow CS 44 to be connected to an adapter. CS 44 can incorporate slot 35 and or the eyelet style attachment points used in the FF 33 embodiment. Slot 35 can be located so that CS 44 can be displayed in landscape and or portrait mode.

One method employed to use this embodiment is as follows. Simply place images 11 in the provided locating provision. Then close the two halves of CS 44 and snap it shut engaging snaps 67. Attach the appropriate adapter and the image display is ready to use. Reverse the procedure to remove the image.

We have disclosed material or materials used to construct an embodiment but in no way will this disclosure serve to limit the embodiment to the specific material specified. Any physical shape or materials possessing the needed mechanical properties, physical properties and specifications could be substituted to construct these embodiments. These shapes include but are not limited to: round, square, rectangular, et cetera. Materials could include but are not limited to: aluminum, steel, plastic, wood, et cetera. Where not shown in these drawing or described, it is assumed that standard hardware components such as screws, bolts, rivets, glue, et cetera are used for fastening and joining. Manufacturing techniques used in the construction of these embodiments can take any form of process, procedure or method and involve the use of any tool or tools that are used to turn raw materials into finished products. Installation and removal methods, when given, are for example only and are in no way intended to limit the embodiments to these methods.

We place no limitations upon these embodiments, as we are not aware of all types of vase 100 and mounting 101 designs currently available in the cemetery environment.

Many design revisions and reiterations will undoubtedly occur in the future to compensate for this and other unforeseen circumstances. This said, the embodiments disclosed in this document reveal the use of the cemetery vase 100 and or it's mounting 101 as an attachment point for an image display platform that is connected to the vase 100 and or mounting 101 through an adapter, this in conformance with claim #1 An image display platform that connects to the cemetery monument vase 100 and or its mounting 101 for providing a monument attachment that facilitates the display of photographic, video or other images 11 in the cemetery environment.

Descriptions of how embodiments were constructed are outlined in this document as required by the U.S. Patent Office. We believe we have provided ample information in these disclosures to instill upon one that is skilled in the arts with the ability to replicate at least one incarnation of the embodiments disclosed. As our claims cover a broad spectrum of possibilities, it is understood that these possibilities are in no way limited to the embodiments and examples provided and disclosed here.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. An image display device comprising the combination of an image display platform for displaying images, an insert adapter and vase having an interior and an exterior;

the insert adapter attaching the display platform to the vase; the insert adapter comprising a J-shaped member with an elongated vertical member having a top end and a bottom end, an upward curved member at the bottom end of the elongated vertical member, a downward tab member at the upper end of the elongated vertical member, and a C-shaped radiused portion attached to the elongated vertical member, wherein the C-shaped radiused portion extends perpendicularly with respect to the elongated vertical member;

the upward curved member comprising a descending member, a lower radiused portion, an ascending member and a bent tip;

wherein the image display platform is removably attached to the downward tab member and held on the exterior of the vase;

wherein the J-shaped member is inserted into the interior of the vase such the C-shaped radiused portion is outwardly biased such that the C-shaped radiused portion provides a pushing force against an interior sidewall of the vase and the descending and ascending members exerted an outward force against the interior of the vase to secure the insert adapter within the vase.

* * * * *